US008973325B1

(12) United States Patent
Chai et al.

(10) Patent No.: US 8,973,325 B1
(45) Date of Patent: Mar. 10, 2015

(54) METHOD FOR ROOF DRAINAGE

(71) Applicants: Chongqing University, Chongqing (CN); Shenzhen Yuezhong (Group) Co., Ltd., Shenzhen (CN)

(72) Inventors: Hongxiang Chai, Chongqing (CN); Songming Tan, Chongqing (CN); Hong Wu, Chongqing (CN); Weijie Wang, Chongqing (CN); Ganlin Zhang, Chongqing (CN); Wei Chen, Chongqing (CN); Wei Kang, Chongqing (CN); Zhengsong Wu, Chongqing (CN); Sai Zhang, Chongqing (CN)

(73) Assignees: Chongqing University, Chongqing (CN); Shenzhen Yuezhong (Group) Co., Ltd., Shenzhen (CN)

( * ) Notice: Subject to any disclaimer, the term of this patent is extended or adjusted under 35 U.S.C. 154(b) by 0 days.

(21) Appl. No.: 14/054,814

(22) Filed: Oct. 15, 2013

(51) Int. Cl.
*E04B 1/66* (2006.01)
*E04D 13/04* (2006.01)

(52) U.S. Cl.
CPC ..... *E04D 13/0404* (2013.01)
USPC ..... 52/302.7; 52/198; 52/741.1; 137/131; 137/151

(58) Field of Classification Search
CPC ..... E04D 13/064; E04D 13/0445; E04D 2013/0427; E04D 2013/0853; E04D 13/04; E04D 13/0404; E04D 2013/0422
USPC ..... 52/16, 218, 219, 63, 741.1, 198, 302.1, 52/302.7; 4/498, 508; 220/219; 285/42; 137/131, 142, 151
See application file for complete search history.

(56) References Cited

U.S. PATENT DOCUMENTS

| | | | | | |
|---|---|---|---|---|---|
| 1,791,512 | A * | 2/1931 | Schurman | 210/163 |
| 2,560,586 | A * | 7/1951 | Michaels | 220/219 |
| 3,469,699 | A * | 9/1969 | Blendermann et al. | 210/166 |
| 3,757,812 | A * | 9/1973 | Duncan | 137/142 |
| 4,171,706 | A * | 10/1979 | Loftin | 137/1 |
| 4,171,709 | A * | 10/1979 | Loftin | 137/128 |
| 4,406,300 | A * | 9/1983 | Wilson | 137/132 |
| 4,735,230 | A * | 4/1988 | Detloff | 137/315.08 |
| 5,063,959 | A * | 11/1991 | Peterson | 137/153 |
| 5,179,969 | A * | 1/1993 | Peterson | 137/1 |
| 5,394,657 | A * | 3/1995 | Peterson | 52/12 |
| 5,498,331 | A * | 3/1996 | Monteith | 210/170.03 |
| 5,758,792 | A * | 6/1998 | Jolly | 220/219 |
| 7,048,849 | B2 * | 5/2006 | Wade | 210/154 |
| 8,668,105 | B2 * | 3/2014 | Al-Subaiey | 220/219 |
| 2003/0201217 | A1 * | 10/2003 | Dresmann | 210/163 |

* cited by examiner

*Primary Examiner* — Brian Glessner
*Assistant Examiner* — Gisele Ford
(74) *Attorney, Agent, or Firm* — Matthias Scholl P.C.; Matthias Scholl

(57) ABSTRACT

A method for roof drainage for reducing urban waterlogging, the method including: arranging a drainage device on a roof, the drainage device including a drainage exit and a drainage pipe including a wall; increasing the height of the drainage exit to allow the drainage exit to be between 5 and 10 cm higher than the roof; arranging a water outlet hole having a drainage capacity on the wall of the drainage pipe at a position that has the same height as the roof or is lower than the roof; disposing a siphon including an inlet and an outlet on an upper part of the drainage pipe, allowing the inlet to face the roof, and allowing the outlet to extend into the drainage pipe; and disposing a ball cock mechanism on the wall of the drainage wall to control the water outlet hole to open or close.

13 Claims, 1 Drawing Sheet

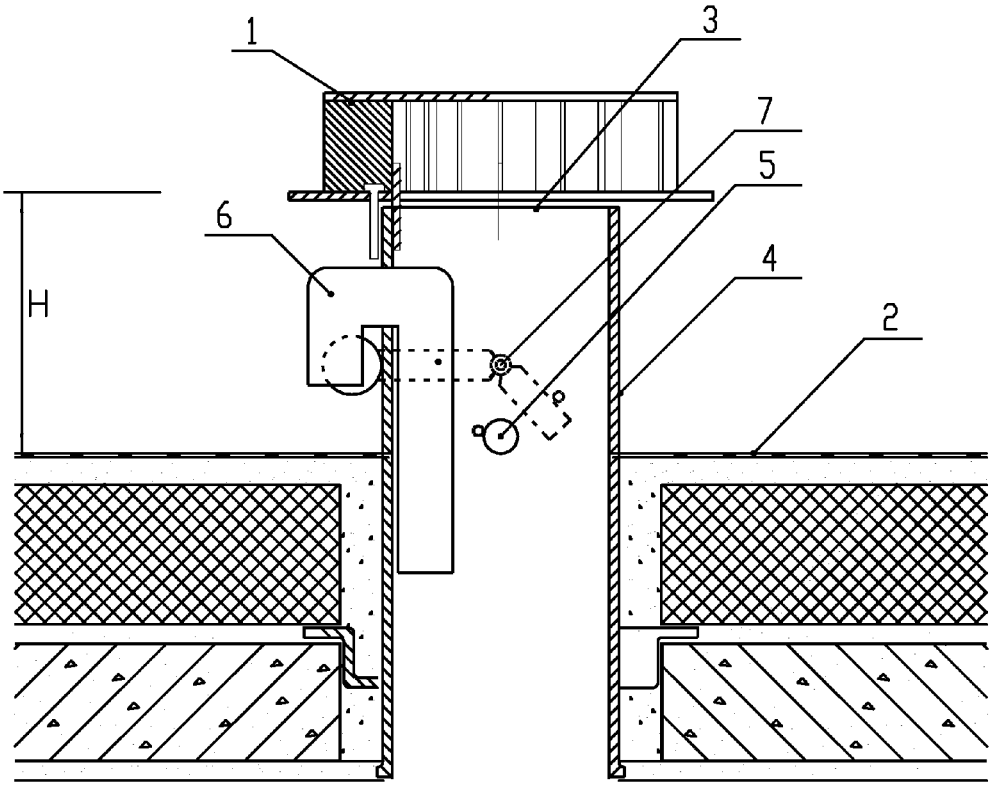
1
3
7
5
6
4
H
2

METHOD FOR ROOF DRAINAGE

BACKGROUND OF THE INVENTION

1. Field of the Invention

The invention relates to a method for roof drainage for reducing urban waterlogging.

2. Description of the Related Art

Roofs of modern buildings are equipped with drainage devices. Drainage exits of the drainage devices are arranged on low-laying areas on the roof for draining the accumulated water, particularly the accumulated water formed within a short period during a cloudburst, out of the building. Typical methods for roof drainage target at accumulating and draining the water out of the building as soon as possible, which facilitates the accumulation of rainwater on the ground of the city. However, with the enlargement of areas impervious to water, such as concrete constructions, asphalt pavements, and parking lots, water flow and the peak flow thereof on the ground surface of the city increase, thereby resulting in more and more urban waterlogging. Disadvantages of conventional methods for roof drainage lie in that the rainwater on various underlying surface is drained simultaneously and the peak flow of the surface runoff is too high, which easily results in urban waterlogging in case of frequent and heavy rainfalls.

SUMMARY OF THE INVENTION

In view of the above-described problems, it is one objective of the invention to provide a method for roof drainage for reducing urban waterlogging and lowering peak flow on the ground surface in the city.

To achieve the above objective, in accordance with one embodiment of the invention, there is provided a method for roof drainage for reducing urban waterlogging. The method comprises: arranging a drainage device on a roof, the drainage device comprising a drainage exit, a drainage pipe comprising a wall, and a water outlet hole; increasing a height of the drainage exit to allow the drainage exit to be between 5 and 10 cm higher than the roof; and arranging the water outlet hole having a certain drainage capacity on the wall of the drainage pipe at a position that has the same height as the roof or is lower than the roof.

Because the arrangement of the drainage exit is higher than the roof, the water level of drainage of the roof increases. In case of cloudbursts, a certain amount of rainwater can be stored by the roof, so that the method of the invention is capable of prolonging the drainage of the rainwater out of the roof, decreasing the peak flow of the rainwater on the ground surface of the city, and reducing the hazards of the urban waterlogging. Furthermore, as the water outlet hole is arranged on the wall of the drainage pipe, the drainage device has a certain drainage capacity for draining off the accumulated rainwater from the roof in case of light rain, moderate rain, and cloudburst. Advantages of the invention are summarized as follows: the method of the invention is capable of prolonging the drainage of the rainwater out of the roof, decreasing the peak flow of the rainwater on the ground surface of the city, and reducing the hazards of the urban waterlogging.

BRIEF DESCRIPTION OF THE DRAWINGS

The invention is described hereinbelow with reference to accompanying drawings, in which the sole FIGURE is an assembly diagram of a drainage device in accordance with one embodiment of the invention.

In the drawings, the following reference numbers are used: 1. Drainage device; 2. Roof; 3. Drainage exit; 4. Drainage pipe; 5. Water outlet hole; 6. Siphon; and 7. Ball cock mechanism.

DETAILED DESCRIPTION OF THE EMBODIMENTS

For further illustrating the invention, experiments detailing a method for roof drainage for reducing urban waterlogging are described below. It should be noted that the following examples are intended to describe and not to limit the invention.

Conception of the method of the invention is that: the rainwater is retained contemporarily on the roof for prolonging the drainage to lower the peak flow of the rainwater drained from the roof, stagger the peak flow of the rainwater drained from the roof and the peak flow of rainwater drained from other underlying surfaces, thereby reducing the peak flow of the surface runoff, and increasing the rainwater storage capacity of the city pipelines.

As shown in FIG. 1, a method for roof drainage for reducing urban waterlogging comprises: arranging a drainage device 1 on a roof 2, the drainage device 1 comprising a drainage exit 3, a drainage pipe 4 comprising a wall, and a water outlet hole 5; increasing a height of the drainage exit 3 to allow the drainage exit 3 to be between 5 and 10 cm higher than the roof 2; and arranging the water outlet hole 5 having a certain drainage capacity on the wall of the drainage pipe 4 at a position that has the same height as the roof or is lower than the roof 2.

Because the arrangement of the drainage exit 3 is higher than the roof 2, the water level of drainage of the roof 2 increases. In case of cloudbursts, a certain amount of rainwater can be stored by the roof 2, so that the method of the invention is capable of prolonging the drainage of the rainwater out of the roof 2, decreasing the peak flow of the rainwater on the ground surface of the city, and reducing the hazards of the urban waterlogging. Furthermore, as the water outlet hole 5 is arranged on the wall of the drainage pipe 4, the drainage device 1 has a certain drainage capacity for draining off the accumulated rainwater from the roof in case of light rain, moderate rain, and cloudburst.

The height difference between the drainage exit 3 and the roof 2 is determined by the rainfall amount precipitating in different regions and the requirement of the roof load according to Load Code for the Design of Building Structure (National Standard of the People's Republic of China), and a preferable height difference is within the range of between 5 and 10 cm.

Because the water outlet hole 5 has a limited drainage capacity, a siphon 6 is disposed on an upper part of the drainage pipe 4 in order to facilitate the water drainage out of the roof 2 after the cloudburst. The siphon 6 comprises an inlet and an outlet; the inlet of the siphon 6 faces the roof 2; and the outlet of the siphon 6 extends inside the drainage pipe 4.

Different rainfall amounts impose different requirements on the water outlet hole 5 of the water drainage device 1. In general, the water outlet hole 5 is required to have a complete drainage capacity. In case of cloudburst, the drainage capacity of the water outlet hole 5 is required to be reduced, or even to be closed, to realize the retention of the rainwater. In the invention, a ball cock mechanism 7 controls opening and closing of the water outlet hole. The water outlet hole is often in an open state. The water outlet hole is closed by the ball cock mechanism 7 if a water level on the roof reaches a preset height.

For example, a demonstration area of green building in Chongqing has an area of 3 ha, in which, a building area is 0.63 ha, accounting for 21% of the total; a public green area is 0.81 ha, accounting for 27% of the total; a waterscape area is 0.33 ha, accounting for 11% of the total; a road area is 0.27 ha, accounting for 9% of the total; and a hard-surface area is 0.96 ha, accounting for 32% of the total. Residential buildings include high floors and have a plurality of floors; and an availability of the building roof is 100%.

1. Designed rainwater flow Q in conventional rainwater drainage system in the residential area A formula of the designed rainwater flow Q is as follows:

$$Q=\psi_m qF$$

in which, $\psi_m$ represents an average runoff coefficient and is calculated by weighted average of different underlying surfaces; q represents an intensity of the cloudburst in Chongqing, and $$q=\frac{2822(1+0.775lgP)}{(t+12.8^{0.076})^{0.77}},$$

where p is 2a, t is 5 min, F is 3 ha, so that Q=693.62 L/s.

TABLE 1

Calculation table for flow runoff coefficient

| Species of underlying surfaces | Water system | Green area | Concrete and asphalt road | Crushed stone Road surface | Hard roof | Average runoff coefficient $\Psi_m'$ (not including the roof) | Average runoff coefficient $\Psi_m$ (including the roof) |
|---|---|---|---|---|---|---|---|
| Runoff coefficient Ψ | 1 | 0.25 | 0.9 | 0.5 | 1 | 0.418 | 0.628 |
| Percentage of a total area | 11 | 27 | 9 | 32 | 21 | 89 | 100 |

2. Determination of time $t_1$ for the rainwater on the roof to produce runoff according to the increased height H of the drainage exit As a rainfall depth is $$H_1=\int_0^T i\,dt=\int_0^T \frac{A_1(1+clgP)}{(t+b)^n}\,dt,$$

thus a rainfall duration is $$t=\left(\frac{(-n+1)H}{\Psi_{roof}A_1(1+clgP)}+b^{-n+1}\right)^{\frac{1}{n-1}}-b,$$

so that the relationship of the rainfall depth $H_1$ and the rainfall duration is calculated, and the rainfall depth for the rainwater on the roof to produce the runoff is equal to the increased height of the drainage exit. Take the increased height of the drainage exit being 50 mm as an example, when the storm return period is 2a and the rainfall duration is $t_1$=26.77 min, the rainfall depth is equal to the increased height of the drainage exit, that is, when the increased height of the drainage exit is 50 mm, runoff will not be produced until the rainfall depth on the roof is 26.77 min.

3. Designed rainwater flow Q in improved rainwater drainage system in the residential area a) at $t_0$, a designed rainwater flow $Q_1$ of other underlying surfaces except the roof is $Q_1=\psi_m' qF$ in which, $\psi_m'$=0.418, F=2.37 ha, $t_0$=5 min, and P=2a, so that $Q_1$=362.94 L/s.

b) at $t_1+t_0$, a designed rainwater flow $Q_2$ of the residential area is $Q_2=\psi_m qF$ in which, $\psi_m$=0.628, F=3ha, $t_1$=26.77 min, and P=2a, so that $Q_2$=346.47 L/s.

It is known from the principal of ultimate storm intensity that $Q'=\mathrm{Max}\{Q_1, Q_2\}$, the designed rainwater flow Q' in improved rainwater drainage system in the residential area is Q'=362.94 L/s.

4. Reduction rate of the rainwater peak flow in the residential area and maximum caliber of the drainage pipe a) ΔQ=Q−Q'=693.62−362.94=330.68 L/s, that is, the reduction rate of the rainwater peak flow=ΔQ/Q×100%=47.67%.

b) Q=693.62 L/s, Q'=362.94 L/s, i represents 0.002, it is known from the hydraulic Calculation chart that DN=900, DN'=700 mm, that is the maximum caliber of the drainage pipe is 700 mm, and a reduction of the maximum caliber of the drainage pipe is 200 mm.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method for roof drainage, the method comprising:

a) arranging a drainage device on a roof, the drainage device comprising a drainage exit and a drainage pipe comprising a wall;

b) increasing a height of the drainage exit to allow the drainage exit to be between 5 and 10 cm higher than the roof; and c) arranging a water outlet hole having a drainage capacity on the wall of the drainage pipe at a position that has the same height as the roof or is lower than the roof;

d) disposing a siphon on an upper part of the drainage pipe, the siphon comprising an inlet and an outlet, allowing the inlet to face the roof, and allowing the outlet to extend into the drainage pipe; and e) disposing a ball cock mechanism on the wall of the drainage pipe to control the water outlet hole to open or close, so that when a water level on the roof reaches a preset height, the water outlet hole is closed by the ball cock mechanism.

2. The method of claim 1, wherein when the water level on the roof falls below the preset height, the water outlet hole is opened by the ball cock mechanism.

3. The method of claim 2, wherein when the water level on the roof reaches or raises above the preset height, water is stored in the drainage pipe and on the roof; and when the water level on the roof falls below the preset height, the water is discharged from the drainage pipe and from the roof through the water outlet hole.

4. A method for draining water from a roof by using a drainage device, the drainage device comprising:

a drainage pipe comprising a drainage exit, a wall, a water inlet hole, and a water outlet hole; and a ball cock mechanism;

the method comprising:

a) disposing vertically the drainage pipe such that the drainage exit is disposed at a first position that is higher than a surface of the roof;

b) disposing the water inlet hole on the wall and connecting the water inlet hole to the surface of the roof;

c) disposing the water outlet hole on the wall at a second position that is as high as the surface of the roof or that is lower than the surface of the roof; and d) disposing the ball cock mechanism on the wall, wherein when a level of the water with respect to the surface of the roof reaches or raises above a third position that is higher than the surface of the roof and that is lower than the first position, the water outlet hole is closed by the ball cock mechanism; and when the level of the water with respect to the surface of the roof falls below the third position, the water outlet hole is opened by the ball cock mechanism.

5. The method of claim 4, wherein when the level of the water with respect to the surface of the roof reaches or raises above the third position, the water flowing into the drainage pipe through the water inlet hole is stored in the drainage pipe; and when the level of the water with respect to the surface of the roof falls below the third position, the water flowing into the drainage pipe through the water inlet hole is discharged from the drainage pipe through the water outlet hole.

6. The method of claim 4, wherein a distance between the first position and the surface of the roof is between 5 and 10 cm.

7. The method of claim 4, further comprising:

disposing a siphon at an upper part of the drainage pipe, the siphon comprising an inlet and an outlet;

disposing the inlet outside of the drainage pipe and above the surface of the roof; and disposing the outlet inside of the drainage pipe.

8. The method of claim 7, wherein when the level of the water is higher than the inlet, the water flows into the drainage pipe through both the water inlet hole and the inlet.

9. A method for draining water from a roof by using a drainage device, the drainage device comprising:

a drainage pipe comprising a drainage exit and a wall, the wall comprising a water inlet hole and a water outlet hole; and a ball cock mechanism, the ball cock mechanism comprising a pivot, a first lever having a first end connected to the pivot and having a second end carrying a floating ball, and a second lever having a third end connected to the pivot and having a fourth end;

wherein:

the drainage exit is adapted to be disposed at a first position that is higher than a surface of the roof;

a first distance between the first position and the surface of the roof is equal to a first preset value;

the water inlet hole is adapted to be connected to a surface of the roof;

the water outlet hole is adapted to be disposed at a second position that is as high as the surface of the roof or that is lower than the surface of the roof;

the pivot is adapted to be disposed on the wall and above the water outlet hole;

the floating ball is adapted to be disposed outside of the drainage pipe and is adapted to be exposed to the water;

the fourth end is adapted to be disposed downward with respect to the third end and in close proximity to the water outlet hole for the purpose of enclosing the water outlet hole;

the floating ball is movable with a level of the water with respect to the roof;

when the floating ball moves with the level of the water with respect to the surface of the roof, the floating ball drives the first lever to rotate about the pivot, and the first lever drives the second lever and the fourth end to rotate about the pivot;

when the floating ball moves with the level of the water with respect to the surface of the roof, the first lever carrying the floating ball and the second lever carrying the fourth end rotate about the pivot in a same direction; whereby when the floating ball is moved upwards, the fourth end is moved downwards, and when the floating ball is moved downwards, the second end is moved upwards;

when the level of the water with respect to the surface of the roof reaches or raises above a second preset value, the fourth end is moved to enclose the water outlet hole to stop draining water from the roof; wherein the second preset value is smaller than the first preset value;

when the level of the water with respect to the surface of the roof falls below the second preset value, the fourth end is moved to open the water outlet hole to allow draining water from the roof; and the method comprising:

a) disposing vertically the drainage pipe such that drainage exit is disposed at the first position, the water inlet hole is connected to the surface of the roof, and the water outlet hole is disposed at the second position; and b) disposing the pivot on the wall and above the water outlet hole;

c) disposing the floating ball outside of the drainage pipe and exposed to the water; and d) disposing the fourth end downward with respect to the third end and in close proximity to the water outlet hole for the purpose of enclosing the water outlet hole.

10. The method of claim 9, wherein when the level of the water with respect to the surface of the roof reaches or raises above the second preset value, the water flowing into the drainage pipe through the water inlet hole is stored in the drainage pipe; and when the level of the water with respect to the surface of the roof falls below the second preset value, the water flowing into the drainage pipe through the water inlet hole is discharged from the drainage pipe through the water outlet hole.

11. The method of claim 9, wherein the first preset value is between 5 and 10 cm.

12. The method of claim 9, further comprising:

disposing a siphon at an upper part of the drainage pipe, the siphon comprising an inlet and an outlet;

disposing the inlet outside of the drainage pipe and above the surface of the roof; and disposing the outlet inside of the drainage pipe.

13. The method of claim 12, wherein when the level of the water is higher than the inlet, the water flows into the drainage pipe through both the water inlet hole and the inlet.

* * * * *